US005941320A

United States Patent [19]

Austin et al.

[11] Patent Number: 5,941,320

[45] Date of Patent: Aug. 24, 1999

[54] DIRECTIONAL BORING MACHINE

[75] Inventors: Gregg A. Austin; David P. Langenfeld; Peter C. Rozendaal, all of Pella, Iowa

[73] Assignee: Vermeer Manufacturing Company, Pella, Iowa

[21] Appl. No.: 08/881,392

[22] Filed: Jun. 24, 1997

[51] Int. Cl.[6] ..... E21B 7/06

[52] U.S. Cl. ..... 175/27; 173/152; 175/61; 175/122

[58] Field of Search ..... 175/27, 45, 51, 175/61, 73, 75, 113, 122, 162, 220; 173/152

[56] References Cited

U.S. PATENT DOCUMENTS

| | | | |
|---|---|---|---|
| 3,881,558 | 5/1975 | Dolza | 175/122 |
| 4,953,638 | 9/1990 | Dunn | 175/45 |
| 5,388,653 | 2/1995 | England | 175/122 |
| 5,431,234 | 7/1995 | Klemm | 173/152 |
| 5,449,046 | 9/1995 | Kinnan | 175/61 |
| 5,555,947 | 9/1996 | Bunker et al. | 175/122 |

OTHER PUBLICATIONS

American Directional Drill., "DD–100 / DD–140 Directional Drills That You Can Keep Busy Year–Round" bearing a date of Mar., 1992.

American Directional Drill., "DD–250 / DD–500 The Highest Quality Drilling Rigs From the World's Foremost Manufacturer" and bearing a date of Feb., 1992.

*Primary Examiner*—William Neuder
*Attorney, Agent, or Firm*—Merchant, Gould, Smith, Edell, Welter & Schmidt, P.A.

[57] ABSTRACT

An underground directional boring machine includes a frame and a drive mechanism slidably mounted on the frame. A drill string is coupled to the drive mechanism for rotation and longitudinal advancement and retraction. A drive assembly moves the drive mechanism along the frame. The drive assembly includes two hydraulic cylinders coupled to the drive mechanism and extending in opposite directions. Free ends of the hydraulic cylinders are releasably secured to the frame at any one of a plurality of positions along the length of the frame. Selective pressurization of the cylinders results in sequential movement of the drive mechanism along the frame by alternative extension and retraction of the cylinders.

14 Claims, 5 Drawing Sheets

DIRECTIONAL BORING MACHINE

I. BACKGROUND OF THE INVENTION

1. Field of the Invention

This invention pertains to underground boring machines and their method of use. More particularly, this invention pertains to an underground boring machine with an improved mechanism for driving a drill head.

2. Description of the Prior Art

In the prior art, there are many examples of directional boring machines, one of which is shown in U.S. Pat. No. 4,953,638. In the '638 patent, an underground boring machine includes a frame (element 20) on which is mounted a drive mechanism (element 24) which can be slidably moved along the longitudinal axis of the frame. The drive mechanism is coupled to a drill string (element 42). The drive mechanism can rotate the drill string about its longitudinal axis. Further, sliding movement of the drive mechanism along the frame causes the drill string to be longitudinally advanced into or withdrawn from the ground. The '638 patent illustrates the use of a chain drive assembly (element 36) for moving the drive mechanism along the frame.

In many prior art designs, a single hydraulic cylinder provides the motive power for moving a chain. Due to the entrainment of the chain around pulleys, an incremental stroke of the cylinder piston would result in a displacement of the drive mechanism equal to about twice the stroke of the piston. However, this would result in the force of the drive mechanism equaling about half of the force applied by the cylinder. Also, any given movement is limited by a cylinder stroke.

When advancing a drill string through the ground, a small-diameter drill string is typically advanced through the ground such that the leading end of the drill string eventually is exposed at a remote location from the drilling apparatus. A reamer device is then attached to the end of the drill string and the drill string is pulled back through the bore initially formed by the boring apparatus. The purpose of the reamer is to increase the size of the bore formed by the drilling machine.

In order to accommodate drilling through adverse conditions (such as hard rock) and to accommodate the formation of large bores on pullback, extremely powerful underground boring machines have been developed. For example, underground boring machines have been developed with maximum thrust or pullback forces of 500,000 pounds (2,224 kN). In such large machines, additional means for advancing the drilling drive mechanism have been developed. These include direct rack and pinion drive systems to replace chain drive systems such as those shown in U.S. Pat. No. 4,953,638. However, in order to withstand the enormous forces associated with such large machines, the rack and pinion direct drive systems are massive in both size and weight.

It is an object of the present invention to provide a mechanism and method for advancing the drive mechanism of an underground boring machine with reduced size and weight when compared to prior art direct drive rack and pinion systems and with capability for handling high-force directional drilling machines (for examples, in excess of 250,000 pounds (1,112 kN)).

II. SUMMARY OF THE INVENTION

According to a preferred embodiment of the present invention, an underground directional boring machine includes a frame with a longitudinal axis. A drive mechanism is mounted on the frame for movement along the axis. A drill string is connected to the drive mechanism. Rotation of the drive mechanism rotates the drill string. The drill string is longitudinally advanced and retracted in response to the drive mechanism moving along the axis of the frame. A drive assembly is provided for moving the drive mechanism. The drive assembly includes two extending and retracting cylinders which extend and retract in response to selective pressurization of the first and second cylinders. One end of each of the cylinders is coupled to the drive mechanism for movement therewith along the axis. Opposite ends of the cylinders extend away from the drive mechanism toward the opposite ends of the frame. The opposite ends of the cylinders are releasably securable to the frame in a plurality of positions between the opposite ends of the frame. The drive mechanism is moved along the axis by securing an end of the first cylinder to the frame and pressurizing the first cylinder to cause the first cylinder to extend, thereby urging the drive mechanism away from the first end of the frame. Thereafter, the second end of the second cylinder (which is in an extended state) is secured to the frame and the second cylinder is pressurized to retract the second cylinder and to further move the drive mechanism.

III. BRIEF DESCRIPTION OF THE DRAWINGS

IV. DESCRIPTION OF THE PREFERRED EMBODIMENT

With reference now to the various drawing figures in which identical elements are numbered identically throughout, a description of the preferred embodiment of the present invention will now be provided.

Figure 1:
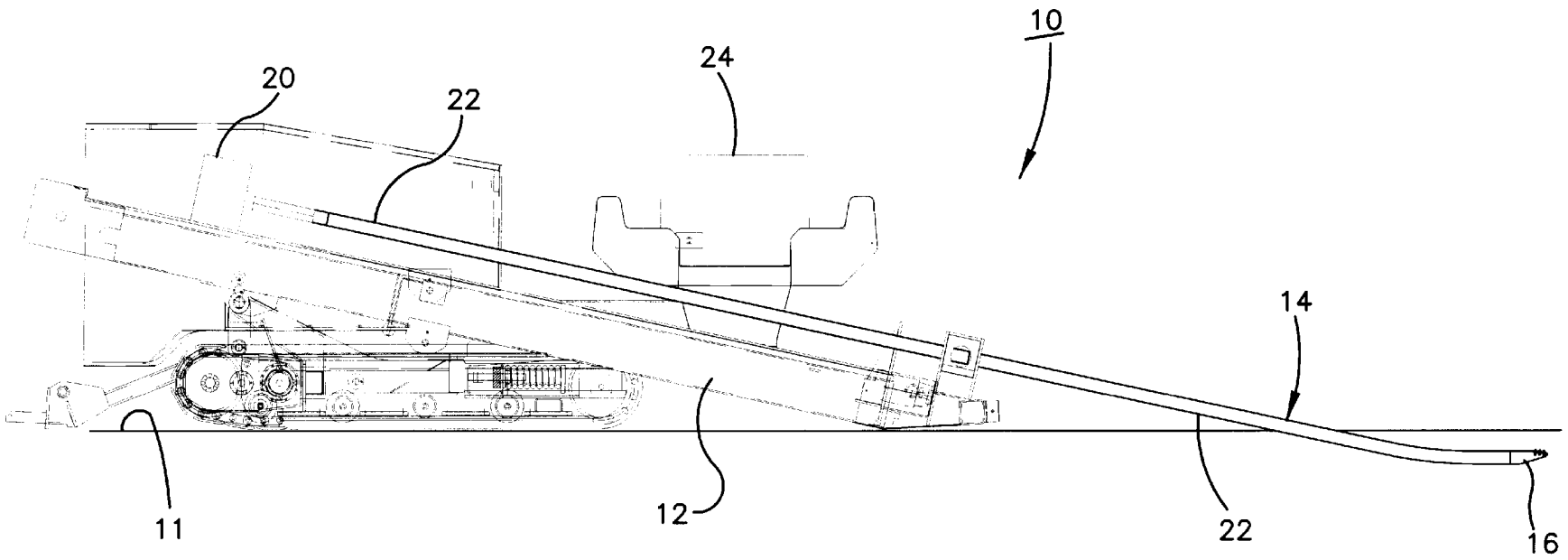
FIG. 1 is a side-elevation view of an underground boring machine.

Referring initially to FIG. 1, drilling apparatus 10 is shown. The drilling apparatus 10 includes a frame 12 mounted on the ground 11 and angled to direct a drill string 14 to penetrate the ground 11.

The drill string 14 terminates at a drill head 16 for cutting away dirt, rock, or the like. A drive mechanism 20 is provided for rotating the drill string 14 and forcing the drill string 14 in a longitudinal direction. An operator's chair 24 is provided so that an operator may sit on the apparatus 10 and operate the controls to rotate the drive mechanism 20 or to advance the drive mechanism 20 longitudinally along the frame 12.

FIG. 1 does not show a drive assembly for advancing the drive mechanism 20 along the frame 12. The present invention is directed to a boring apparatus 10 which contains a novel drive assembly for advancing the drive mechanism 20. The novel drive assembly is shown in FIGS. 2 through 5.

Figure 3:
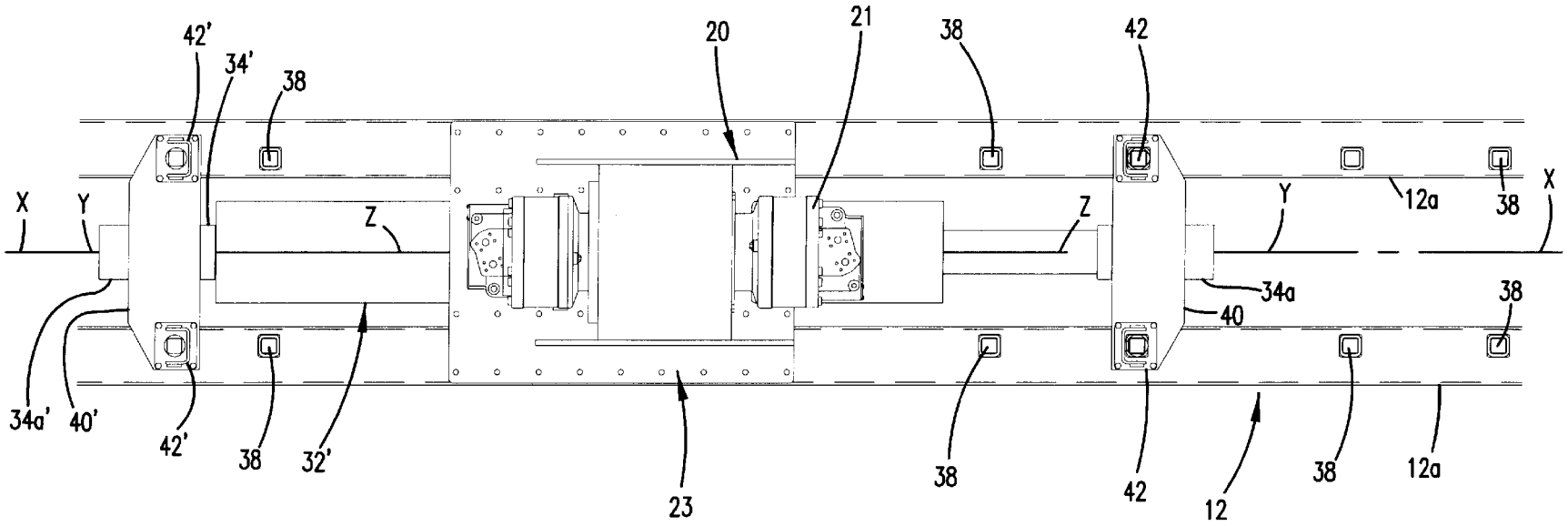
FIG. 3 is a top-plan view of the elements of FIG. 2.

In FIG. 3, the frame 12 is more clearly illustrated as two parallel and spaced-apart rails 12*a*. The frame extends from a front or first end 12*b* to a rear or second end 12*c*.

The drive mechanism 20 is illustrated as a gearbox with an output shaft 21 for coupling to the drill string 22. The drive mechanism 20 is mounted on a carriage 23 which slidably rides on rails 12*a*.

As is customary, the drive mechanism 20 can operate to rotate the shaft 21 both clockwise and counterclockwise along the axis Z—Z of shaft 21. Such rotation causes rotation of a drill string 22 which is coupled to the drive shaft 21.

Sliding movement of the drive mechanism 20 along the longitudinal axis X—X of the frame 12 causes the drive mechanism 20 to force the drill string 22 longitudinally into the ground (when the drive mechanism 20 is advanced toward the front end 12*b* of the frame 12) and to retract the drill string from the ground (when the drive mechanism 20 is advanced toward the rear end 12*c* of the frame 12).

A novel drive assembly 30 is provided for moving the drive mechanism 20 along the frame 12. The drive assembly includes first and second hydraulic cylinders 32,32'. Each of the cylinders 32,32' contains a reciprocating piston 34,34' such that the cylinders 32,32' can extend or retract in response to selective pressurization of the cylinders 32,32'. It will be appreciated that hosing, couplings, and controls for selective pressurization to extend and retract cylinders such as cylinders 32,32' are well-known in the art and are not separately shown.

The pistons 34,34' terminate at free ends 34*a*,34*a*'. The head ends 32*a*,32*a*' (FIG. 2) of cylinders 32,32' are secured to a bracket 36 which, in turn, is secured to the carriage 23. Accordingly, the cylinders 32,32' are coupled to the drive mechanism 20 for movement therewith along axis X—X.

The cylinders 32,32' are positioned between the rails 12*a* with extension axes Y—Y of the cylinders 32,32' extending parallel to the rail axis X—X and shaft axis Z—Z directly beneath shaft axis Z—Z. Cylinder 32 has its piston end 34*a* extending toward the front end 12*b* of the frame 12. Cylinder 32' has its piston end 34*a*' extending toward the rear end 12*c* of the frame 12. The cylinders 32,32' are coaxially aligned.

The piston ends 34*a*, 34*a*' are releasably securable to the frame 12 at a plurality of positions between the first end 12*b* and the second end 12*c* of the frame 12. Specifically, the rails 12*a* are provided with a plurality of transversely aligned holes 38 spaced along the length of the frame 12 at a spacing corresponding to the stroke of the cylinders 32,32'. The piston ends 34*a*,34*a*' are provided with transverse brackets 40,40' secured to the ends 34*a*,34*a'*.

Mounted on opposite ends of each of the brackets 40,40' are hydraulic lock pin cylinders 42,42'. The hydraulic cylinders 42,42' include extending pistons having piston ends 42*a*,42*a*' sized and positioned to extend into the holes 38 in rails 12*a*.

Figure 2:
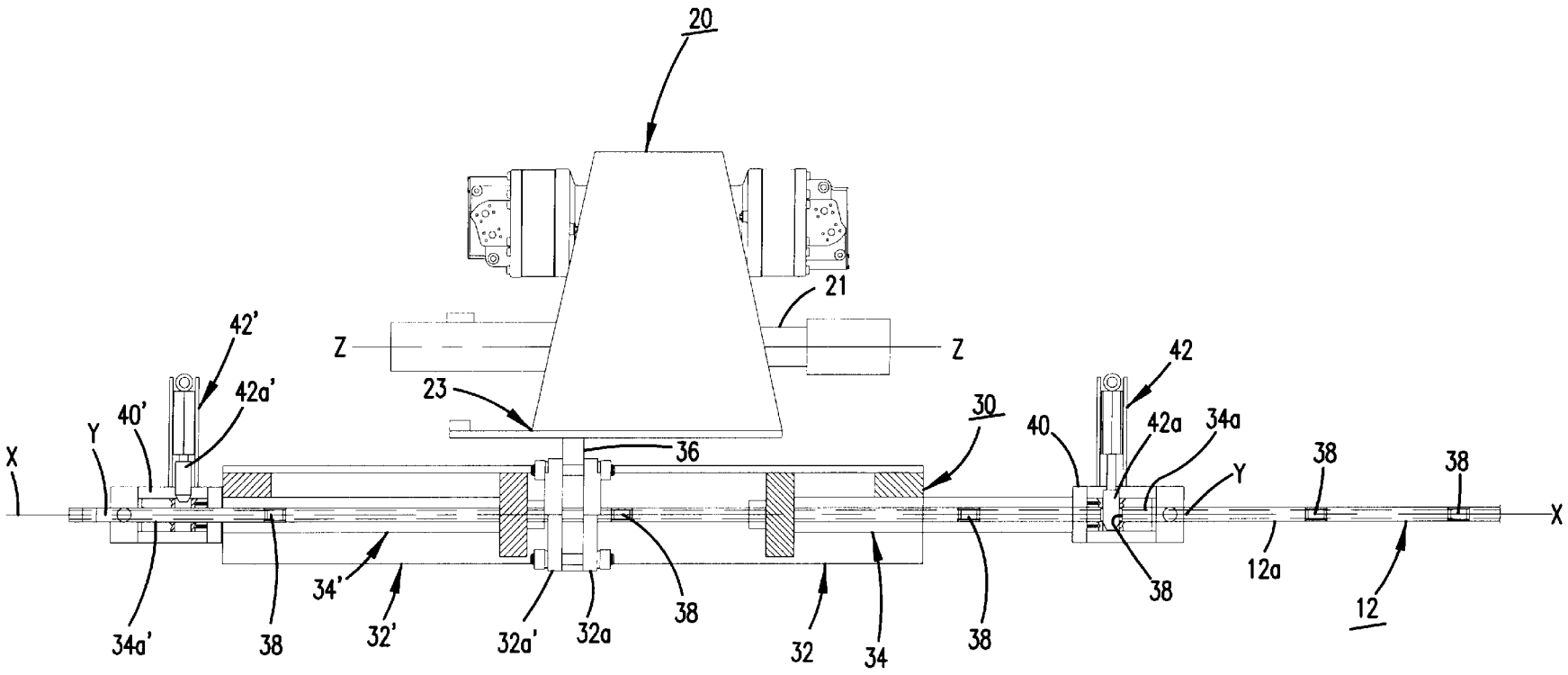
FIG. 2 is a side-elevation view of a drive mechanism for the underground boring machine of FIG. 1, and a novel drive assembly according to the present invention.
Figure 4:
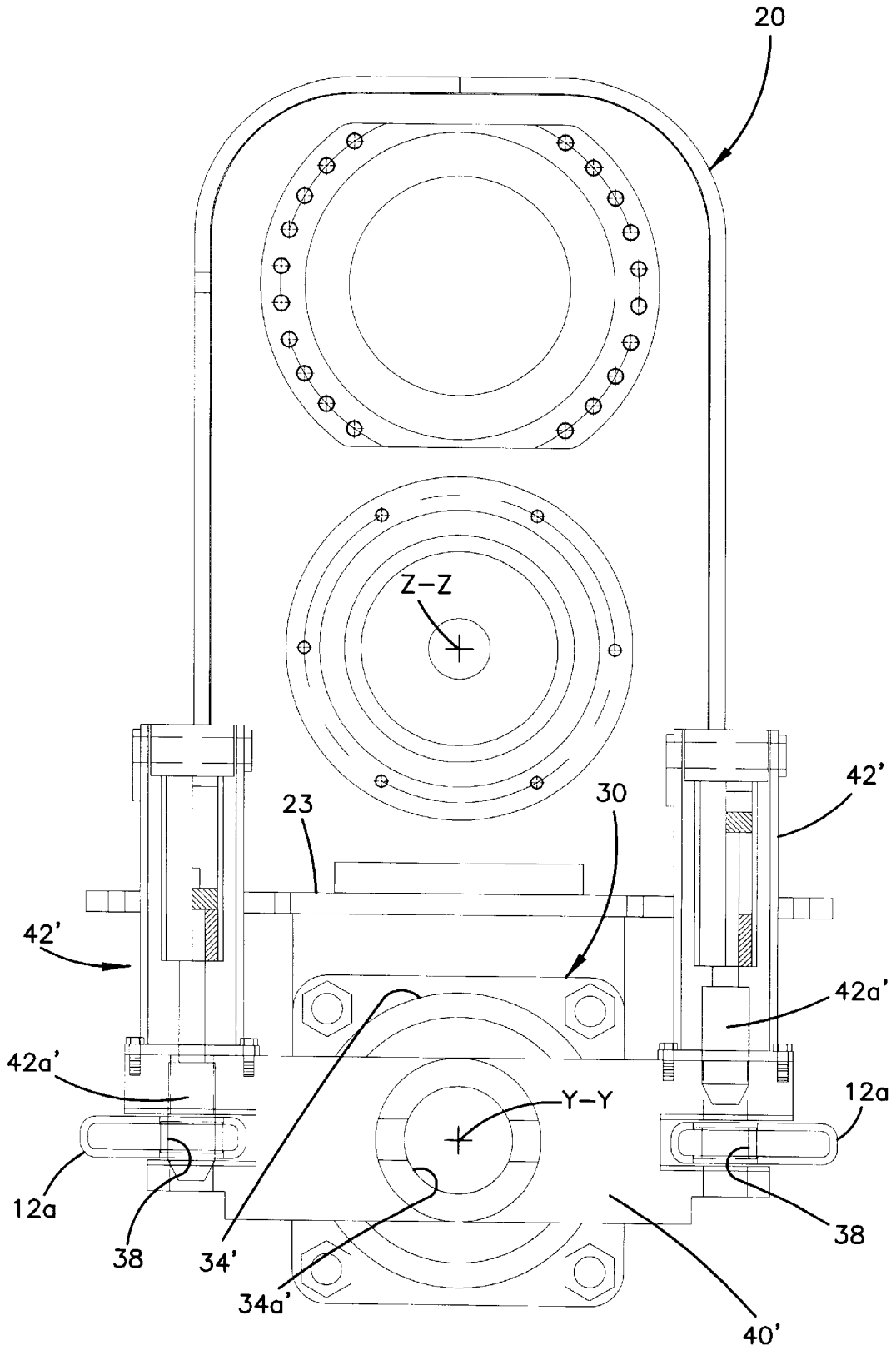
FIG. 4 is an end-elevation view of the elements of FIG. 2.

In FIG. 2, lock pin cylinder 42 is shown in a lock position with piston end 42*a* received within a hole 38 of rail 12*a*. Lock pin cylinder 42' is shown in an unlock position with piston end 42*a*' shown retracted out of hole 38. Similarly, in FIG. 4, the right side cylinder 42' is in an unlock position and the left side cylinder 42' is in a lock position. It will be appreciated that in operation, both of cylinders 42' will be simultaneously locked or unlocked and that showing one of each in a locked and an unlocked position in FIG. 4 is done solely to illustrate the two positions.

The lock pin cylinders 42,42' may be extended or retracted through any suitable control means or may be operated by hand actuation. With the piston ends 42*a*,42*a*' received with the holes 30*a*, the piston ends 34*a*,34*a*' are releasably secured to the frame 12 at a fixed position. With the pistons 42*a*,42*a*' retracted, the piston ends 34*a*,34*a*' are disconnected from the frame 12 and movable relative to the frame 12.

Figure 5:
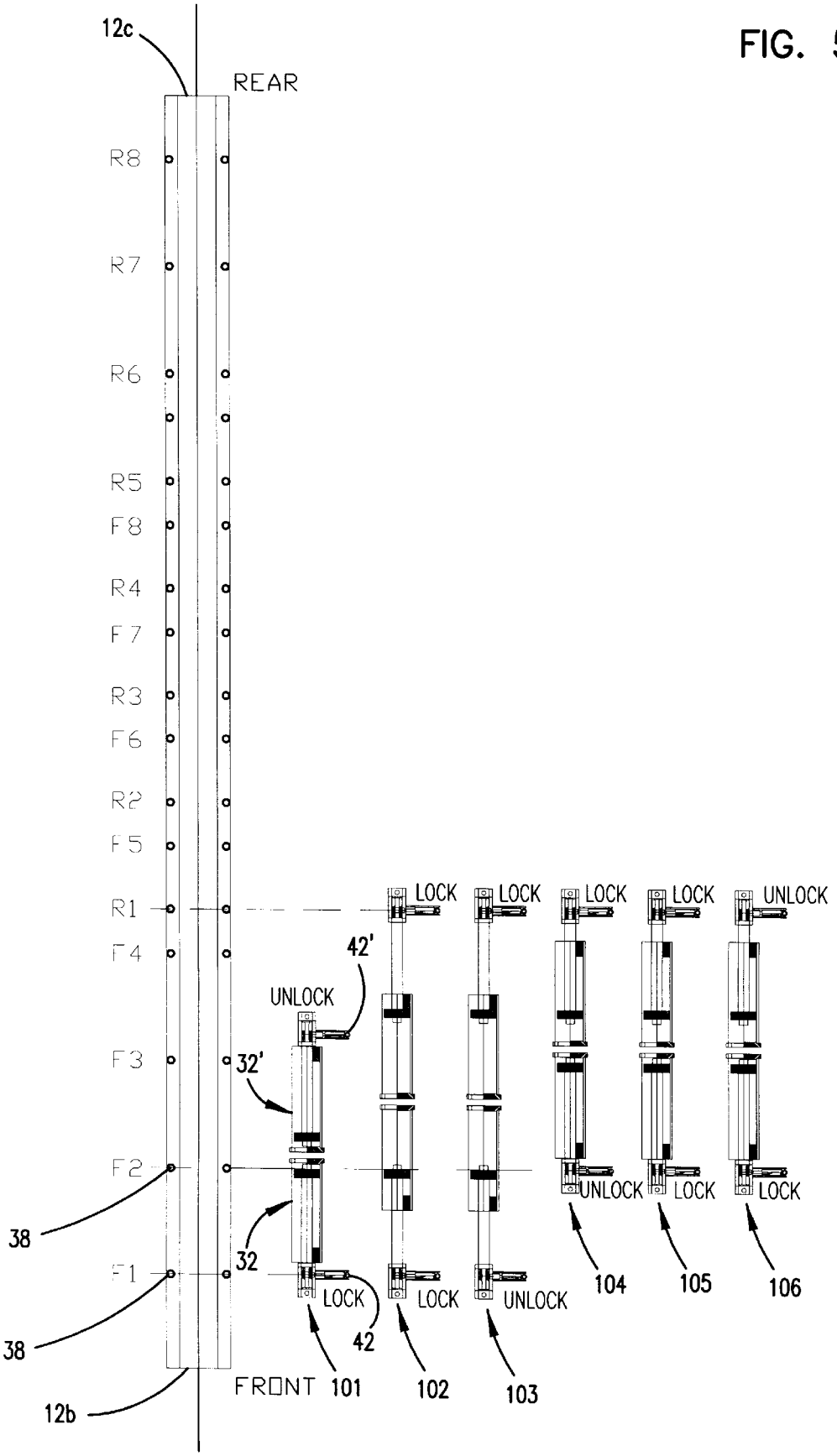
FIG. 5 is a drawing showing a frame for the underground boring machine of FIG. 1 and the hydraulic cylinders of the drive assembly of FIGS. 2 through 4 with the cylinders shown in a plurality of positions and states relative to the frame to illustrate sequential advancement of the cylinders and a coupled drive mechanism along the length of the frame.

With the structure thus disclosed, the drive mechanism 20 may be moved along the axis X—X by selective pressurization of the cylinders 32,32' and selective actuation of the locking cylinders 42,42'. FIG. 5 illustrates a sequential pressurization of the cylinders 32,32' to move the drive mechanism 20 away from the frame front end 12*b* and toward the frame rear end 12*c*.

In FIG. 5, the cylinders 32,32' are shown in an initial state 101 where locking cylinders 42 are in a locked position (i.e., with piston ends 42*a* received within the holes 38) and locking cylinder 42' is shown in an unlocked position (with the piston end 42*a*' retracted from a locking hole 38). Each of the cylinders 32,32' is shown in a retracted position.

In a preferred embodiment, the cylinders 32,32' are each selected to provide a motive force on the drive mechanism 20 sufficient to provide a rated maximum motive force on the drill string 22. For a boring machine 10 having a rated pullback or thrust force of 250,000 pounds (1,112 kN), each of the cylinders 32,32' is selected to have a rated capacity of 250,000 pounds (1,112 kN). It will be appreciated that hydraulic cylinders of such capacity are commercially available items.

When it is desired to pull back a drill string by advancing the drive mechanism 20 from the front end 12*b* toward the rear end 12*c*, both of cylinders 32,32' are pressurized so as to cause extension of the cylinders. Since only cylinder 32 has its piston 34 secured to the frame 12, only cylinder 32 is providing a motive force on the drive mechanism 20 and drill string 22. Therefore, the motive force applied to the drill string 22 is the 250,000 pound force of the cylinder 32 (or such other force which the operator may select within the operating capacity of the cylinder 32). Since cylinder 32' is unlocked from the frame 12, cylinder 32' freely extends to an extended position (without applying a motive force to the drive mechanism 20) while cylinder 32 extends to its extended position and urges the drive mechanism 20 toward the rear end 12*c*. When both the cylinders 32,32' are fully extended, the piston end 34*a*' of cylinder 32' is secured to the frame 12 by urging the locking cylinders 42' to a locked position such that all of the locking cylinders 42,42' are now in a locked position and the cylinders 32,32' are now in what can conveniently be called a transition state illustrated as state 102 in FIG. 5.

In the transition state 102, and with both sets of locking cylinders 42,42' in the locked position, the pullback load may be transferred from cylinder 32 to cylinder 32' by adjusting pressurization within the cylinders 32,32'. Preferably, the transfer of the load from cylinder 32 to cylinder 32' will occur proportionately. Namely, cylinder 32 originally entered the transition state 102 carrying 100% of the load being applied to the drill string 22. Within the transition state 102, the amount of load carried by cylinder 32 is reduced. The amount of the reduction is simultaneously taken up by cylinder 32'. In other words, if cylinder 32 is carrying 80% of the pullback force on the drill string 22, then cylinder 32' will carry 20% of the pullback force. This progressive transfer of the load will increase to a point where both of cylinders 32,32' are carrying 50% of the pullback force on drill string 22 and will further progress to a point where 80% of the pullback force on the drill string 22 is carried by cylinder 32' and the remaining 20% is carried by cylinder 32. At the end of the transition state 102, 100% of the pullback force on drill string 22 is carried by cylinder 32' and none of the pullback force on the drill string 22 is carried by cylinder 32.

As a result of the proportional transfer of the load from cylinder 32 to cylinder 32', the amount of force experienced by the drill string 22 remains constant throughout the transition state 102 having the benefits of the teachings of the present invention. It will be appreciated that controlling cylinders in the manner thus described will be well-known to one of ordinary skill in the art. At the end of the transition state 102, when 100% of the load is carried by cylinder 32', the first locking cylinders 42 may be shifted to an unlocked position illustrated by state 103 and both of the cylinders 32,32' are in a fully extended position.

Following the end of the transition phase as illustrated in state 103, both hydraulic cylinders 32,32' are pressurized (reverse to the pressurization occurring in state 101) to cause both of the cylinders 32,32' to retract, as illustrated in state 104. Since locking cylinder 42' is locked to the frame 12, the retraction of cylinder 32' causes the drive mechanism 20 to be further advanced toward the rear end 12*c* of frame 12. Further, since locking pin cylinder 42' is locked and locking pin cylinder 42 is unlocked, 100% of the pull force is provided by cylinder 32' with the retraction of cylinder 32 occurring without providing any pull force on the drill string 20.

Following the full retraction of state 104, both of locking pin cylinders 42,42' are locked to initiate a transition of a load from cylinder 32' to cylinder 32 as illustrated in state 105. In state 105, both of the locking pins 42,42' are locked and the force load is transferred from cylinder 32' to cylinder 32 proportionately so that the total force applied by both cylinders 32,32' equals the full maximum force desired on the drill string 22 in a manner similar to the transfer of load between cylinders 32,32' discussed with reference to state 102.

Following the full transfer of the load from cylinder 32' to cylinder 32, the locking pin cylinder 42' is unlocked and 100% of the pull force and load is being applied by cylinder 32, as illustrated in state 106. State 106 is identical to state 101, except only that state 106 represents that the drive mechanism has been moved toward rear end 12c a distance, L, equal to twice the stroke of a cylinder (i.e., one expansion stroke of cylinder 32 and one retraction stroke of cylinder 32'). To further advance the movement of the drive mechanism 20 toward rear end 12*c*, the sequence is repeated. It will be further appreciated that the sequence can be reversed in order to move the drive mechanism 20 toward front end 12*b*.

The foregoing description of the novel apparatus and method of use discloses what can conveniently be referred to as a "walking cylinder" system where cylinders 32,32' are alternatively retracting and expanding to sequentially move the drive mechanism 20 any desired distance. At all times, the load experienced on the drill string 22 is held constant. Unlike chain drive systems, the present invention can handle substantial loads and provide a distance of movement of the drive mechanism which corresponds one-to-one with a stroke of the cylinder.

Unlike the prior art rack and pinion designs, the present invention can handle substantial forces on the drill string without the mammoth size and weight associated with prior rack and pinion-driven directional boring machines. For example, with respect to rack and pinion directional boring machines capable of 250,000 pounds (1,112 kN) of pullback force, such devices typically require two semi trailers to move the device due to its mammoth size and weight, whereas the present invention achieves the same pullback force in a design which can be hauled by a single semi trailer. Also, due to its substantially reduced size and weight, a substantial cost savings can be achieved for the same functional force.

Having described the present invention in the preferred embodiment, modifications and equivalents of the disclosed concepts will become apparent to those skilled in the art. It is intended that such modifications and equivalents shall be included within the scope of the claims which are appended hereto.

What is claimed is:

1. An underground directional boring machine comprising:

a frame having a longitudinal axis extending from a first frame end to a second frame end;

a drill string;

a drive mechanism mounted on said frame for movement along said axis, said drill string connected to said drive mechanism for said drive mechanism to rotate said drill string and to longitudinally advance and retract said drill string in response to said drive mechanism moving along said axis;

a drive assembly including:

a first expanding and retracting cylinder having a first end and a second end which move toward and away from one another in response to selective pressurization of said first cylinder;

a second expanding and retracting cylinder having a first end and a second end which move toward and away from one another in response to selective pressurization of said second cylinder;

said first ends of each of said first and second cylinders coupled to said drive mechanism for movement therewith along said axis;

said second end of said first cylinder extending from said first end of said first cylinder toward said first frame end;

said second end of said second cylinder extending from said first end of said second cylinder toward said second frame end;

said second ends of said first and second cylinders releasably securable to said frame at a plurality of positions between said first and second frame ends;

said first and second cylinders selectively pressurized to selectively extend and retract said first and second cylinders;

whereby said drive mechanism may be moved along said axis by securing said second end of said first cylinder to said frame and pressurizing said first cylinder to cause said first cylinder to extend thereby urging said drive mechanism away from said first frame end and with said second end of said second cylinder subsequently being secured to said frame with said second cylinder being extended and with said second cylinder then being pressurized to retract said second cylinder to further move said drive mechanism away from said first frame end.

2. An underground directional boring machine according to claim 1 wherein said first and second cylinders extend generally parallel to said axis.

3. An underground directional boring machine according to claim 1 wherein said first and second cylinders are pressurized so that only a selected one of said first and second cylinders is extending and retracting while a second end of said selected one is secured to said frame.

4. An underground directional boring machine according to claim 3 wherein, between said extension of said first cylinder and said retraction of said second cylinder, pressurization of said cylinders is varied for a total motive force of said first and second cylinders to be approximate to a motive force of any one of said cylinders during said extension and retraction.

5. A method of operating an underground directional boring machine having a frame having a longitudinal axis extending from a first frame end to a second frame end, a drill string, a drive mechanism mounted on said frame for movement along said axis, said drill string connected to said drive mechanism for said drive mechanism to rotate said drill string and to longitudinally advance and retract said drill string in response to said drive mechanism moving along said axis, and a drive assembly including a first expanding and retracting cylinder having a first end and a second end which move toward and away from one another in response to selective pressurization of said first cylinder, a second expanding and retracting cylinder having a first end and a second end which move toward and away from one another in response to selective pressurization of said second cylinder, said first ends of each of said first and second cylinders coupled to said drive mechanism for movement therewith along said axis, said second end of said first cylinder extending from said first end of said first cylinder toward said first frame end, said second end of said second cylinder extending from said first end of said second cylinder toward said second frame end, said second ends of said first and second cylinders releasably securable to said frame at a plurality of positions between said first and second frame ends, said first and second cylinders selectively pressurized to selectively extend and retract said first and second cylinders, said method comprising:

securing said second end of said first cylinder to said frame;

pressurizing said first cylinder to cause said first cylinder to extend thereby urging said drive mechanism away from said first frame end;

securing said second end of said second cylinder to said frame with said second cylinder being extended; and pressurizing said second cylinder to retract said second cylinder to further move said drive mechanism away from said first frame end.

6. A method according to claim 5 wherein said first and second cylinders are pressurized so that only a selected one of said first and second cylinders is extending and retracting while a second end of said selected one is secured to said frame.

7. A method according to claim 6 wherein, between said extension of said first cylinder and said retraction of said second cylinder, pressurization of said cylinders is varied for a total motive force of said first and second cylinders to be approximate to a motive force of any one of said cylinders during said extension and retraction.

8. A method according to claim 5 comprising repeating said extension and retraction to completely advance said drive mechanism.

9. A method of operating an underground directional boring machine having a frame including a longitudinal axis extending from a first frame end to a second frame end, a drill string, a drive mechanism mounted on said frame for movement along the axis, the drill string connected to the drive mechanism for the drive mechanism to rotate the drill string and to longitudinally advance and retract the drill string in response to the drive mechanism moving along the axis, and a drive assembly including a first expanding and retracting cylinder having a first end and a second end which move toward and away from one another in response to selective pressurization of the first cylinder, a second expanding and retracting cylinder having a first end and a second end which move toward and away from one another in response to selective pressurization of the second cylinder, the first ends of each of the first and second cylinders coupled to the drive mechanism for movement therewith along the axis, the second ends of the first and second cylinders releasably securable to the frame at a plurality of positions between the first and second frame ends, the first and second cylinders selectively pressurized to selectively extend and retract the first and second cylinders, the method comprising:

(a) securing the second end of the first cylinder to the frame;

(b) pressurizing the first cylinder to urge the drive mechanism away from the first frame end;

(c) securing the second end of the second cylinder to the frame;

(d) releasing the second end of the first cylinder from the frame; and (e) pressurizing the second cylinder to further move the drive mechanism away from the first frame end.

10. A method according to claim 9, wherein the step of pressurizing the first cylinder includes pressurizing the first cylinder to cause the first cylinder to extend thereby urging the drive mechanism away from the first frame end.

11. A method according to claim 10, wherein the step of pressurizing the second cylinder includes pressurizing the second cylinder to retract the second cylinder to further move the drive mechanism away from the first frame end.

12. A method according to claim 10, wherein the step of pressurizing the second cylinder includes pressurizing the second cylinder to extend the second cylinder to further move the drive mechanism away from the first frame end.

13. A method according to claim 9, wherein pressurization of said cylinders is varied for a total motive force of said first and second cylinders to be approximate to a motive force of any one of said cylinders during said extension and retraction.

14. A method according to claim 13, further comprising repeating said extension and retraction to completely advance said drive mechanism.

* * * * *